US006305910B1

(12) United States Patent
Miura et al.

(10) Patent No.: US 6,305,910 B1
(45) Date of Patent: Oct. 23, 2001

(54) MULTI-STAGE PUMP DEVICE

(75) Inventors: Atsuyuki Miura, Aichi-ken; Yoshihiro Naito, Nagoya; Noboru Ohtani, Handa; Koichi Nakayama, Chiryu, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/538,504

(22) Filed: Mar. 30, 2000

(30) Foreign Application Priority Data

Mar. 30, 1999 (JP) ..... 11-090053

(51) Int. Cl.[7] ..... F04B 3/00; F04B 5/00; F04B 25/00

(52) U.S. Cl. ..... 417/244; 417/248

(58) Field of Search ..... 417/2, 244, 356, 417/248; 415/121.1; 285/93, 166, 226, 49; 138/114; 60/325

(56) References Cited

U.S. PATENT DOCUMENTS

| | | | | |
|---|---|---|---|---|
| 3,874,708 | * | 4/1975 | Gresens | 285/93 |
| 4,372,114 | * | 2/1983 | Burnham | 60/325 |
| 4,523,612 | | 6/1985 | Kuklo . | |
| 5,133,578 | * | 7/1992 | Whightsil et al. | 285/166 |
| 5,340,165 | * | 8/1994 | Sheppard | 285/226 |
| 5,437,479 | * | 8/1995 | Hartling et al. | 285/49 |
| 5,639,222 | * | 6/1997 | Kieffer | 417/244 |
| 5,713,727 | * | 2/1998 | Veronesi et al. | 417/356 |
| 5,820,354 | * | 10/1998 | Wild et al. | 417/244 |
| 6,056,510 | * | 5/2000 | Miura et al. | 417/2 |
| 6,062,266 | * | 5/2000 | Burkhardt | 138/114 |
| 6,089,823 | * | 7/2000 | Cronin et al. | 415/121.1 |
| 6,196,810 | * | 3/2001 | Taniguchi et al. | 417/248 |

FOREIGN PATENT DOCUMENTS

| | | |
|---|---|---|
| 0 447 716 | 9/1991 | (EP) . |
| 0 674 106 | 9/1995 | (EP) . |
| 0 796 996 | 9/1997 | (EP) . |
| 2 111 155 | 6/1983 | (GB) . |
| 7-305689 | 11/1995 | (JP) . |

* cited by examiner

*Primary Examiner*—Teresa Walberg
*Assistant Examiner*—Leonid M Fastovsky
(74) *Attorney, Agent, or Firm*—Oblon, Spivak, McClelland, Maier & Neustadt, P.C.

(57) ABSTRACT

A multi-stage pump device includes a plurality of pump devices, each of the pump devices having a pump portion feeding working fluid under pressure, and a connecting portion provided between at least two of the pump devices, through which working fluid pumped by the respective pump devices passes. The connecting portion is expandable in a direction of the length thereof and is provided with a sealing structure to prevent a leakage of the working fluid. The connecting portion may be two telescopically arranged pipes or a bellows.

16 Claims, 4 Drawing Sheets

MULTI-STAGE PUMP DEVICE

BACKGROUND OF THE INVENTION

1. Field of the Invention

This invention is related to a multi-stage pump device which is used for feeding working fluid under pressure.

2. Description of the Related Art

A multi-stage pump device is shown in FIG. 4 as a pump device related to this invention. The multistage pump device shown in FIG. 4 comprises pump devices A, B, C, and D arranged in line to form a four stage pump device. Each pump device A, B, C, and D is firmly secured by a support frame 15. A casing 10 of the pump device A and a casing 20 of the pump device B are provided with a flange 12 and a flange 13, respectively. The flange 12 and the flange 13 are sealed by sealing means and firmly connected by a fastening belt 14.

The working fluid fed by the pump device A flows through a passage provided in the flange 12 and flows into the pump device B through a passage provided in the flange 13 of the pump device B. The working fluid thus flows into the pump B, and further flows into the pump device C through passage similarly provided in the flange (not numbered) of pump device C. As explained above, by arranging a plurality of pump devices in line, a high degree of vacuum can be obtained if used in a vacuum pump device, for instance.

In the conventional multi-stage pump device, however, each pump device is firmly secured by the supporting frame 15. Therefore stress occurs in the connecting area between the flange 12 and the flange 13 due to the thermal expansion of the casing 10 and the casing 20, respectively, by the rise of the temperature in the pump while the pump device is working. The stress may deform the casings 10, 20, and such deformation partially loads the bearings provided in the casings 10, 20 and shortens a life span of the bearings.

SUMMARY OF THE INVENTION

It is, therefore, an object of the present invention to provide an improved multi-stage pump device overcoming the foregoing drawbacks and including a plurality of pump devices connected in line to perform a multi-stage operation.

According to a first aspect of the present invention, the above and other objects are achieved by a multi-stage pump device comprising a plurality of pump devices, each of the pump devices having a pump portion feeding working fluid under pressure, and a connecting portion provided between at least two of the pump devices, through which working fluid pumped by the respective pump devices passes, wherein the connecting portion is expandable in a direction of the length thereof, and wherein the connecting portion is provided with a sealing structure to prevent a leakage of the working fluid.

According to the first aspect of the present invention, the ability of the connecting portion to expand makes it possible to reduce the transfer of heating stress to a casing of each pump device while the pump devices are in operation. Therefore, bearings provided in the casings of the pump devices may not receive the partial load which is often caused by the deformation of the casing by the heat stress. Thus, the working life span of the pump device of this invention can be extended.

According to a second aspect of the present invention, the above and other objects are achieved by a multi-stage pump device comprising a plurality of pump devices, each of the pump devices having a pump portion feeding working fluid under pressure, and a bellows provided between at least two of the pump devices, through which working fluid pumped by the respective pump devices passes.

According to the second aspect of the present invention, the deformation of the bellows makes it possible to reduce the transfer of heating stress to a casing of each pump device while the pump devices are in operation. Therefore, bearings provided in the casings of the pump devices may not receive the partial load which is often caused by the deformation of the casing by the heat stress. Thus, the working life span of the pump device of this invention can be extended.

BRIEF DESCRIPTION OF THE DRAWINGS

The multi-stage pump device of the present invention will be explained in more detail with the accompanying drawings, in which.

DETAILED DESCRIPTION OF THE PREFERRED EMBODIMENTS

Figure 3:
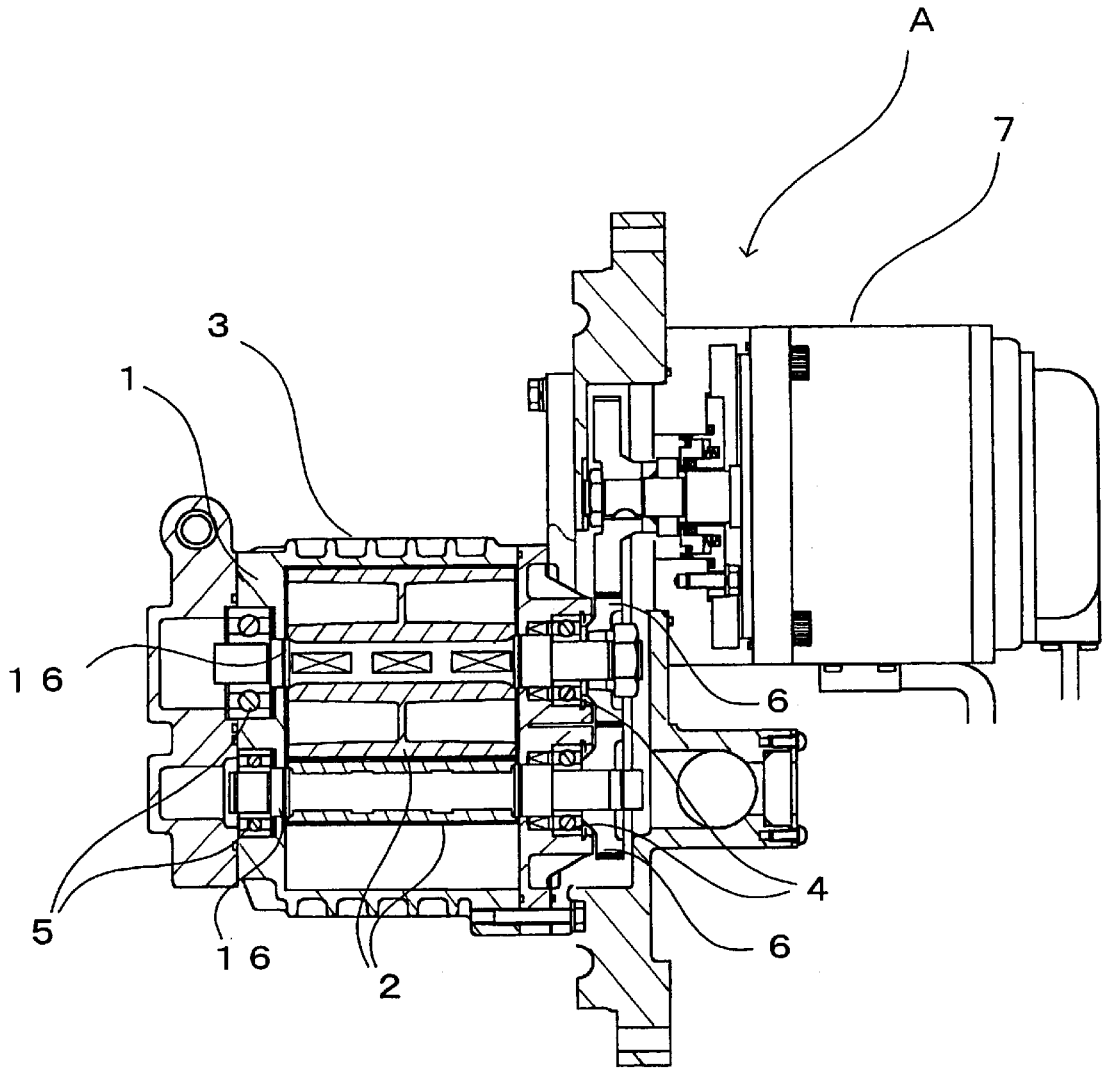
FIG. 3 shows a cross sectional view of a Roots-type pump device.
Figure 4:
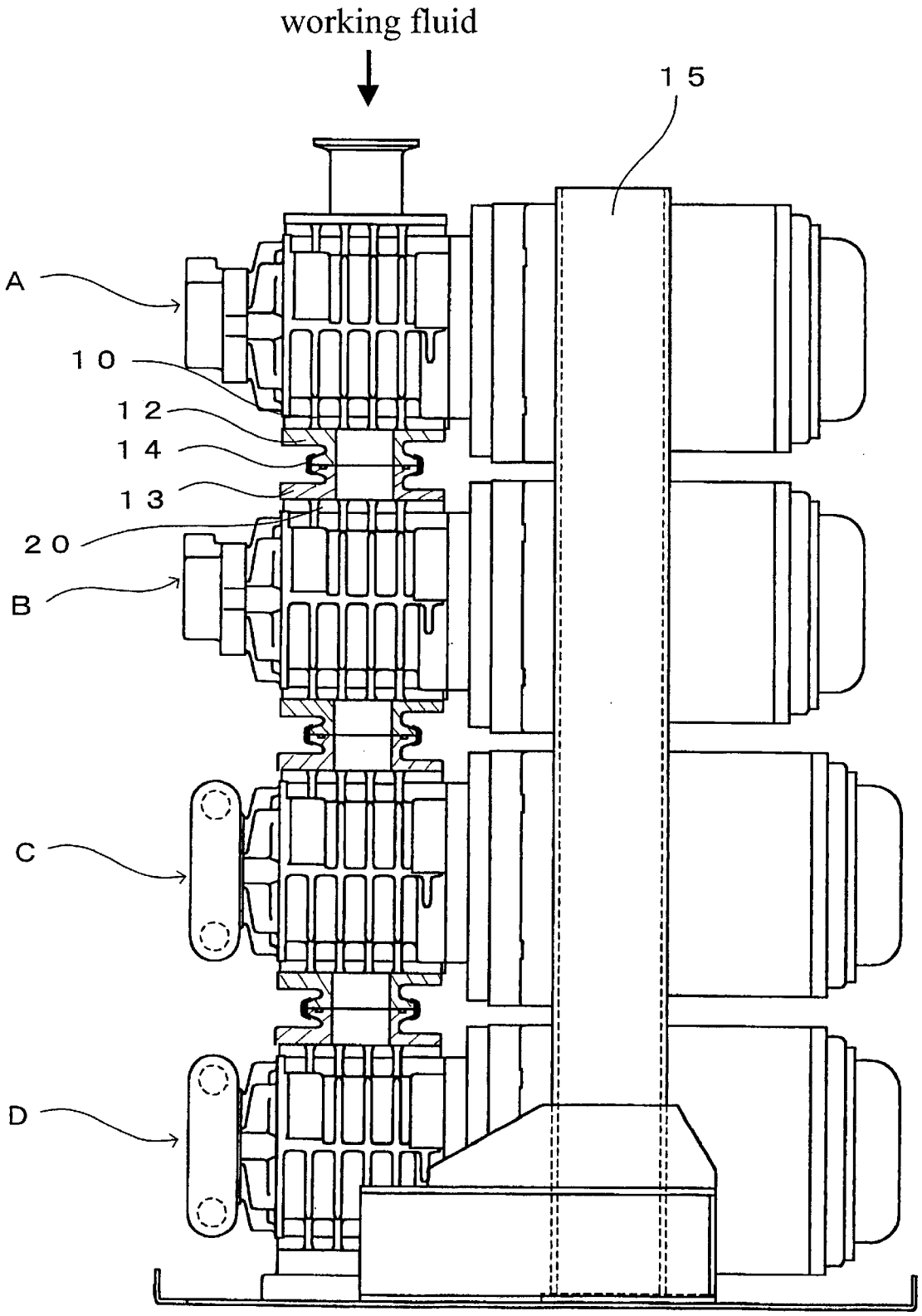
FIG. 4 shows an illustration of a conventional pump device.

FIG. 3 shows a cross sectional view of a Roots-type pump device of a first embodiment of the present invention. The Roots-type pump device A includes a casing 1 having a specific internal shape for the Roots-type, rotors 2 rotated at predetermined intervals and supported by bearings 4 and 5 in the casing 1, synchronizing gears 6 rotating in opposite directions and having a 90 degree phase difference from the rotors, and a driving portion 7 connected with the synchronizing gears 6 for driving the gears 6. Bearings 4 and 5 which support the rotation of the shaft are connected respectively to both ends of the rotor shafts 16.

Shafts 16 connected with the gears 6 are rotated in opposite directions when the synchronizing gears 6 are driven by the driving portion 7. The shafts 16 mounting the rotors 2 are rotated while keeping the phase difference. The working fluid is pressurized at the pump portion 3 formed by the rotors 2 and the casing 1, and is transmitted therefrom to the next pump device.

Figure 1:
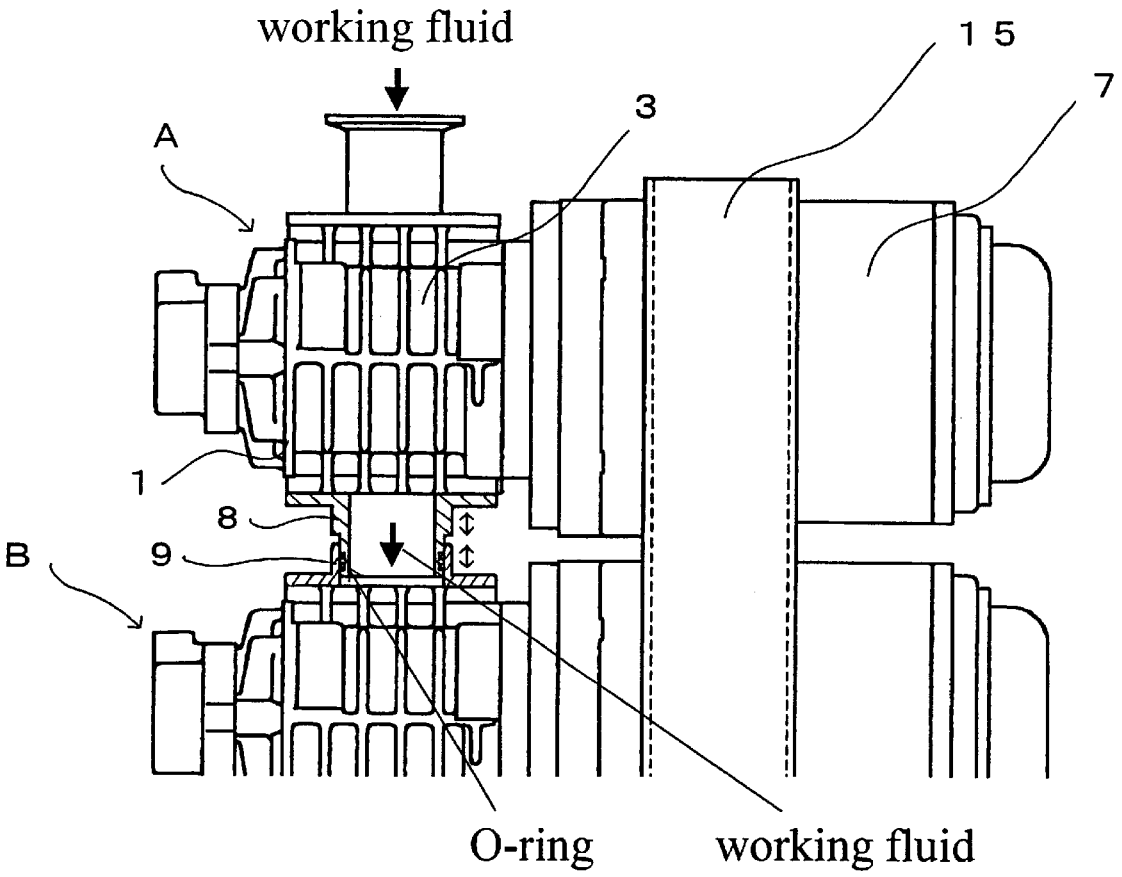
FIG. 1 shows a connecting portion using a cylindrical pipe of a multi-stage pump device embodying this invention.

FIG. 1 shows a multi-stage pump device including a plurality of Roots-type pump devices A and B having the structure shown in FIG.3 and arranged in line. The pump device A has a cylindrical discharge pipe 8 for transmitting the fluid under pressure from the pump device A to the pump device B. The pump device B has a cylindrical inlet pipe 9 for receiving the working fluid from the cylindrical discharge pipe 8 of the pump device A. The cylindrical discharge pipe 8 is inserted into the cylindrical inlet pipe 9 fits closely thereinto in a telescoping fashion so that the working fluid will not leak. Preferably, an O-ring is provided therebetween to improve fluid tightness, but any other sealing structure permitting relative axial movement of the pipes could instead be used. The pipes 8 and 9 thus form a connecting portion, as an example of a working fluid guide means, which is expandable and contractible in the connecting direction.

When the temperature at the pump portion 3 rises due to the rotational movement of the rotors and the pressurization of the working fluid, because of the tight connection of the driving portion 7 with the supporting frame 15, a heat expansion difference occurs between the pump portion 3 and the drive portion 7 due to the temperature difference therebetween.

As the connecting portion formed by the cylindrical pipes 8 and 9 fixed to the pump devices A and B, respectively, is expandable in the connecting direction, the heat expansion due to the difference of temperature can be absorbed by the pipes fluid tightly sliding relative to one another at the connection therebetween. By absorbing the heat expansion, the connecting portion avoids any partial load which may be generated on the bearings 4, 5 provided on both ends of the shafts 16 of rotors 2 of the pump device 3 due to the deformation of the casing 1. Thus the working life span of the pump device can be improved.

Figure 2:
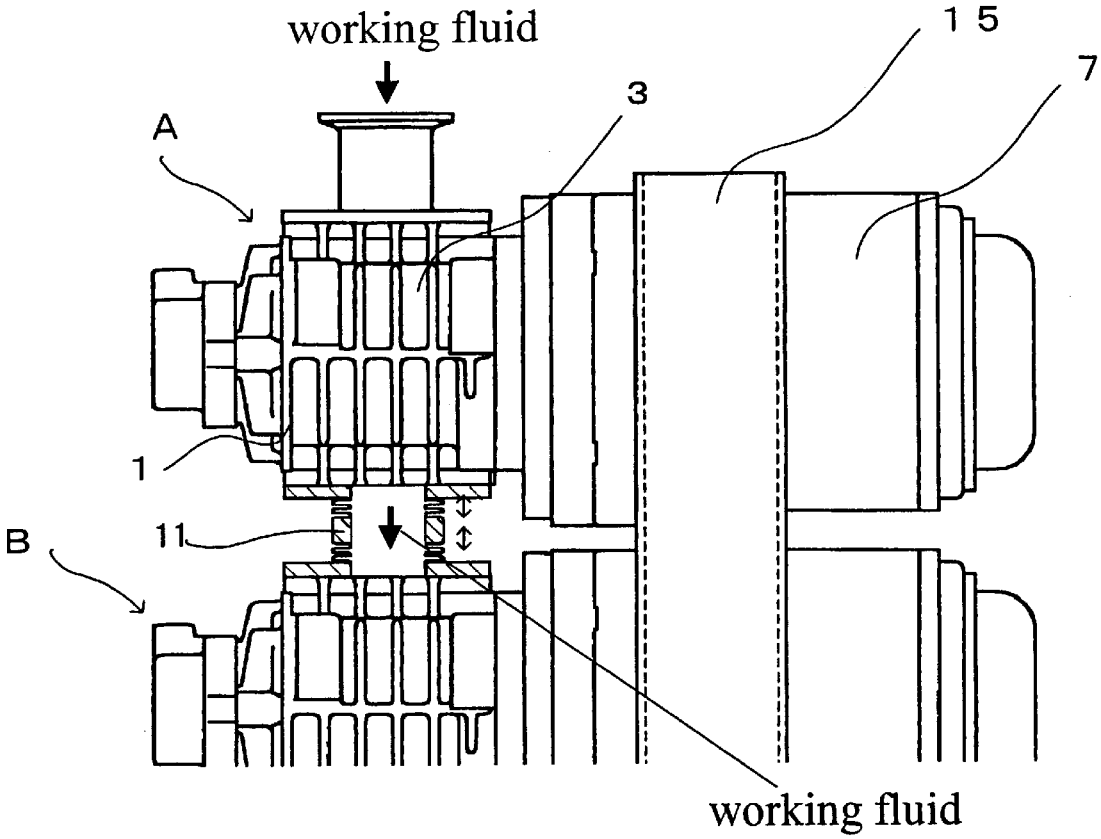
FIG. 2 shows a connecting portion using a bellows of a multi-stage pump device embodying this invention.

FIG. 2 shows an embodiment using an expandable bellows 11 as an example of a working fluid guide means at a connecting part between the adjacent pump devices A, B. This embodiment using elastic bellows 11 instead of cylindrical pipes is also expandable in the connecting direction, and can prevent a partial load on the bearing 4, 5 provided on both ends of the shafts of rotors 2 of the pump portion 3, and extend the working life span of the pump devices A, B.

According to this invention, by setting an expandable connecting portion in the connecting direction between the adjacent pump devices, the transfer of a partial load caused by the deformation of the casing to the bearing on both ends of the rotor shaft of the pump part can be avoided, and the working life span of the pump device can be extended.

The invention has thus been shown and described with reference to specific embodiments, however, it should be understood that the invention is in no way limited to the details of the illustrated structures but changes and modifications may be made without departing from the scope of the appended claims.

What we claimed is:

1. A multi-stage pump device comprising;

a plurality of pump devices, each of the pump devices having a pump portion feeding working fluid under pressure; and a connecting portion provided between at least two of the pump devices, through which working fluid pumped by the respective pump devices passes, wherein the connecting portion is expandable in a direction of the length thereof, and wherein the connecting portion is provided with a sealing structure to prevent a leakage of the working fluid.

2. The multi-stage pump device of claim 1, wherein said connecting portion comprises two telescopically arranged pipes.

3. The multi-stage pump device of claim 1, wherein said sealing structure is an O-ring arranged between said pipes.

4. A multi-stage pump device comprising;

a plurality of pump devices, each of the pump devices having a pump portion feeding working fluid under pressure; and a bellows provided between at least two of the pump devices, through which working fluid pumped by the respective pump devices passes.

5. A multi-stage pump device comprising:

at least two pump units; and working fluid guide means for establishing a fluid flow connection between said pump units, wherein said guide means is capable of being deformed relative to each pump unit.

6. A multi-stage pump device as set forth in claim 5, wherein the guide means includes a pair of telescopic pipes which are extended from the pump units, respectively, and a seal member provided between the pipes.

7. A multi-stage pump device as set forth in claim 5, wherein the guide means comprises a bellows.

8. A multi-stage pump device as set forth in claim 7, wherein the bellows is made of rubber.

9. A multi-stage pump device comprising;

a plurality of pump devices, each of the pump devices having a pump portion feeding working fluid under pressure and a driving portion which is tightly connected with a supporting frame; and a connecting portion provided between at least two of the pump devices, through which working fluid pumped by the respective pump devices passes, wherein the connecting portion is expandable in a direction of the length thereof, and wherein the connecting portion is provided with a sealing structure to prevent a leakage of the working fluid.

10. The multi-stage pump device of claim 9, wherein said connecting portion comprises two telescopically arranged pipes.

11. The multi-stage pump device of claim 9, wherein said sealing structure is an O-ring arranged between said pipes.

12. A multi-stage pump device comprising;

a plurality of pump devices, each of the pump devices having a pump portion feeding working fluid under pressure and a driving portion which is tightly connected with a supporting frame; and a bellows provided between at least two of the pump devices, through which working fluid pumped by the respective pump devices passes.

13. A multi-stage pump device comprising:

at least two pump units;

working fluid guide means for establishing a fluid flow connection between said pump units, wherein said guide means is capable of being deformed relative to each pump unit;

at least two driving units; and each driving unit is tightly connected with a supporting frame.

14. A multi-stage pump device as set forth in claim 13, wherein the guide means includes a pair of telescopic pipes which are extended from the pump units, respectively, and a seal member provided between the pipes.

15. A multi-stage pump device as set forth in claim 13, wherein the guide means comprises a bellows.

16. A multi-stage pump device as set forth in claim 15, wherein the bellows is made of rubber.

* * * * *